US005138786A

United States Patent [19]

Fischer

[11] Patent Number: 5,138,786

[45] Date of Patent: Aug. 18, 1992

[54] INSTA-GUARD FIREARM PROTECTION

[76] Inventor: Michael G. Fischer, Post Office Box 571, Deer Park, N.Y. 11729

[21] Appl. No.: 731,666

[22] Filed: Jul. 17, 1991

[51] Int. Cl.[5] ..... A47F 7/00

[52] U.S. Cl. ..... 42/70.11; 211/64

[58] Field of Search ..... 42/106, 70.11; 211/64; 248/316.5, 316.8

[56] References Cited

U.S. PATENT DOCUMENTS

| | | | |
|---|---|---|---|
| 3,507,398 | 4/1970 | Schaefer | 211/64 |
| 3,802,612 | 4/1974 | Smith | 211/64 |
| 4,155,608 | 5/1979 | Orlewicz | 211/64 |
| 4,299,045 | 11/1981 | Cervantes | 42/70.11 |
| 4,776,471 | 10/1988 | Elkins | 211/64 |
| 4,936,038 | 6/1990 | Johnson et al. | 42/106 |

*Primary Examiner*—Michael J. Carone

*Attorney, Agent, or Firm*—Galgano & Belkin

[57] ABSTRACT

Apparatus for mounting and locking on a wall a rifle or a shotgun comprising a U-shaped extended housing formed from a sheet of heavy gauge steel. A cover of sheet steel is hinged along one leg of the housing while tabs and flaps are provided which come together to prevent the apparatus from being pried open. A combination lock is employed mounted on the cover. The housing is provided with holes for screws to attach the apparatus to a wall, and in particular to both walls forming a corner.

12 Claims, 2 Drawing Sheets

INSTA-GUARD FIREARM PROTECTION

BACKGROUND OF THE INVENTION

The present invention relates to firearms and more particularly to a wall mountable safety device for use with rifles and shotguns.

Millions of persons own rifles, shotguns and pistols for recreational and security purposes and these firearms are usually stored in their homes. With so many of these weapons available there is a problem of limiting access to them. The owner of such a firearm is or should be concerned that such a weapon not be handled by a person not properly trained or not having permission of the owner to do so.

The consequences of unauthorized and improper use of weapons are well known. Children shoot themselves or each other, impulsive use of guns during stress or in the heat of domestic squabbles results in tragedies, and outright theft of weapons causes economic loss.

Many devices have been developed and are in use for wall mounting and safeguarding firearms. The ones available for use with rifles and shotguns have a number of shortcomings relating to ease of use, cost, and ability to withstand attempts to defeat the security aspects of the devices.

A number of such devices are shown in the following United States Patents.

U.S. Pat. No. 1,513,267 illustrates a safety guard for use with shot guns and rifles to prevent accidental discharge of the weapon. No provision is shown for the wall mounting of the guard.

U.S. Pat. No. 3,018,576 discloses a locking safety device for firearms which similarly lacks provision for wall mounting.

U.S. Pat. No. 3,637,180 shows a wall mount device for guns which relies on a member passing through the trigger guard. No housing is provided for the locking mechanism.

U.S. Pat. No. 4,395,837 describes a trigger protector for firearms in which a sheath including a strap is provided for a pistol. No wall mounting is involved.

U.S. Pat. No. 4,299,045 discloses a wall mountable backplate for a detachable gun lock. This invention relates to a pistol and no housing is provided.

U.S. Pat. No. 4,912,867 shows firearm safety apparatus comprising a sleeve for use on a pistol.

U.S. Pat. No. 4,644,676 describes firearm safety apparatus involving the use of a flexible wrapping for a pistol to prevent inadvertent access to the trigger.

U.S. Pat. No. 4,916,842 discloses a protective device for the trigger guard of a gun to prevent inadvertent discharge of the weapon.

U.S. Pat. No. 4,934,083 shows a child-proof lock for firearms using a strap and a cap for the trigger of a pistol. No housing or wall mounting is provided.

None of the preceding patents teaches the present invention.

SUMMARY OF THE INVENTION

This invention concerns an improved wall mountable safety guard for a rifle, shotgun, or handgun incorporating features which increase the difficulty of prying apart the housing which encloses the trigger guard.

A preferred embodiment of this invention comprises a housing of thick steel plate capable of being mounted on walls, in a corner, and in such places as homes, boats, RV's trailers, trucks, etc. The housing is hinged and is provided with side flaps and tongues in the front which are designed to be burglar proof by rendering the housing virtually free of being opened by prying. The firearm is placed within the housing, the latter enclosing the trigger guard of the weapon. A combination lock is employed to prevent unauthorized opening of the housing.

The use of a combination lock renders the device child proof, although a padlock can also be employed. The construction renders the safety guard easy to install in closet, behind a door, in a car, truck, or RV, and even in a boat or plane. In addition, the safety guard is inexpensive and easy to manufacture so that the cost will make the device affordable in virtually any home or place having such a weapon.

It is thus a principal object of this invention to provide a wall mountable safety guard for a rifle, shot gun, or similar firearm with improved safety characteristics and economic construction.

Other objects and advantages of this invention will hereinafter become obvious from the following description of preferred embodiments of this invention.

DESCRIPTION OF THE PREFERRED EMBODIMENTS

Figure 1:
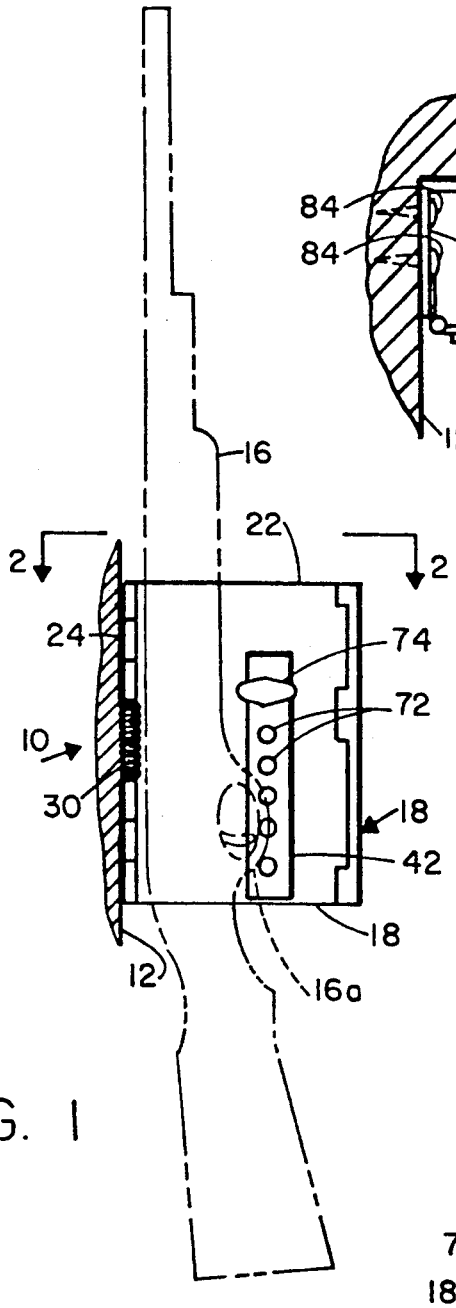
FIG. 1 is an elevation view of a preferred embodiment of this invention containing a shotgun mounted in the corner of two walls.
Figure 2:
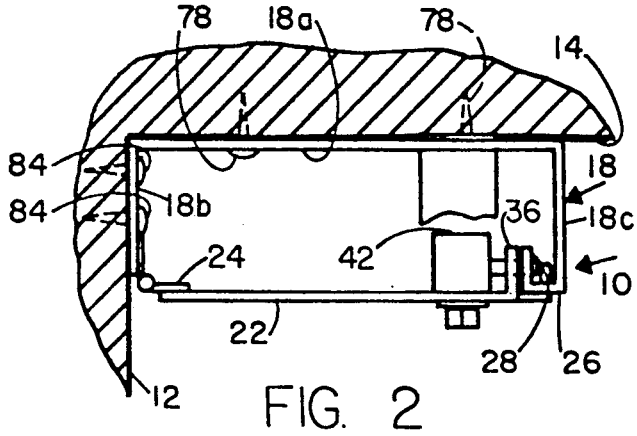
FIG. 2 is a view partially broken away taken along 2—2 of FIG. 1.

Referring to FIGS. 1 and 2, a firearm safety guard 10 embodying the principles of this invention is mounted in the corner formed by walls 12 and 14. Safety guard 10 contains a shot gun 16 with trigger guard 16*a* shown in phantom. It is understood that safety guard 10 need not be mounted in corner although that is preferred for maximum security.

Guard 10 comprises a U-shaped housing 18 with a closeable cover 22 supported at one edge by a hinge 24 extending the full length of housing 18 and cover 22 and welded to the inside of both. Housing 18 is open at the top and bottom to permit gun 12 to be mounted therein in the manner illustrated in FIG. 1.

Housing 18 is U-shaped with a back face 18*a* and one side face 18*b* having one edge terminating at hinge 24 while the oppositely facing side edge 8*c* is bent back to form a shoulder 26 with an inwardly extending tab 28. One of the knuckles on hinge 24 may be replaced with a coil spring 30 attached to the hinge shaft and cover 22 so that when the lock to be described below is open, cover 22 will pop open.

Figure 4:
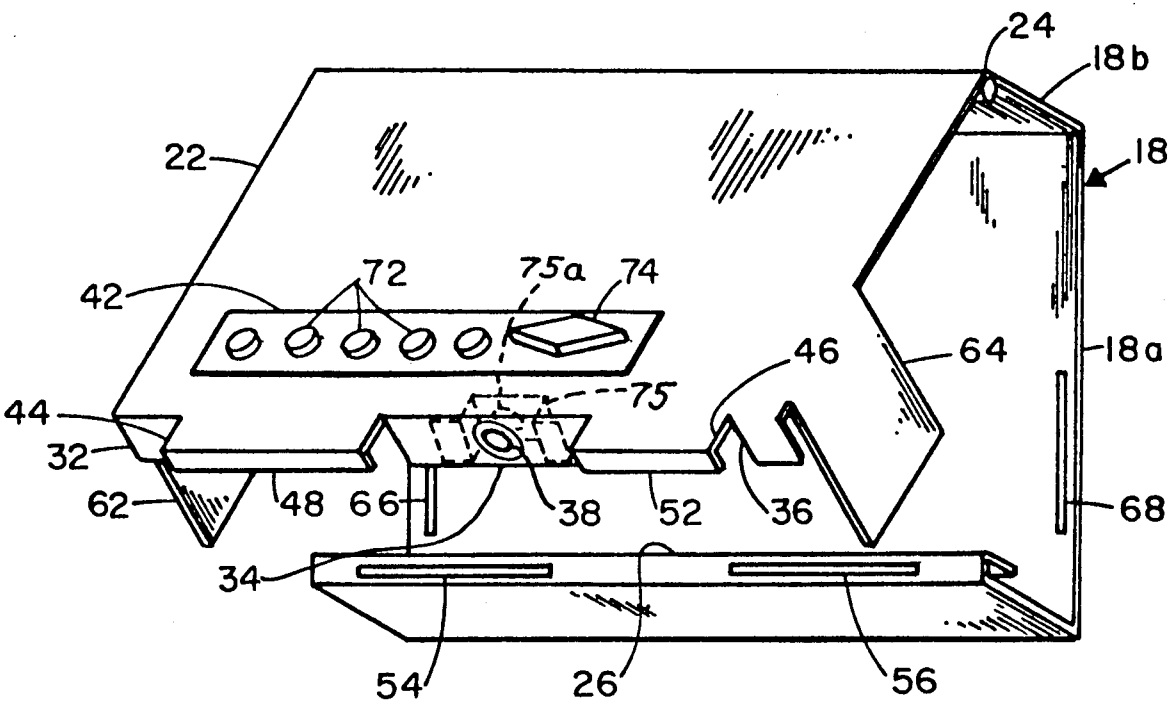
FIG. 4 is an isometric view of the housing taken from the front partially open.
Figure 5:
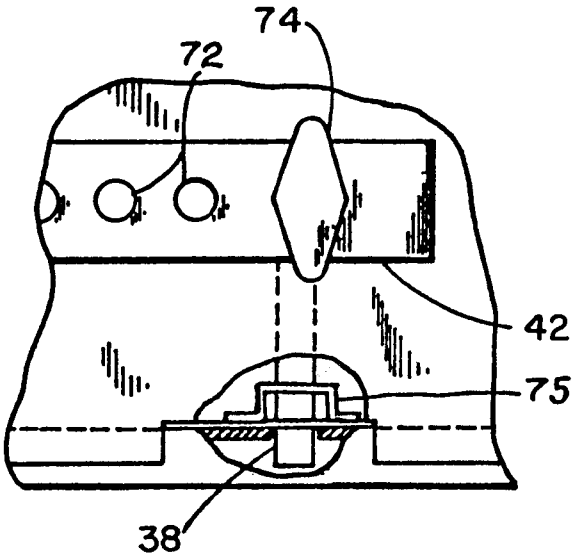
FIG. 5 show details partially broken away of the locking area.

Cover 22 along one edge is similarly attached to hinge 24 while the oppositely facing edge is bent to form an inwardly facing, spaced tabs 32, 34 and 36 which abut tab 28 on housing 18, as best seen in FIG. 4. As also seen in FIG. 5, bolt 38 extends from a lock 42 which will be more particularly described below.

As best seen in FIG. 4, between the spaced tabs 32, 34, and 36 formed at the free edge of cover 22 are a pair of extensions 44 and 46 with inwardly extending tabs 48 and 52 which pass through slots 54 and 56 in shoulder 26 when cover 22 is closed. The combination of tabs 32, 34, and 36 abutting tab 28 and tabs 48 and 52 passing through slots 54 and 56 makes it virtually impossible to pry open cover 22 along its free edge.

Along the side edges of cover 22 are a pair of projecting flaps 62 and 64 which penetrate the back face 18*a* through a pair of slots 66 and 68, respectively, when cover 22 is closed. It should be noted as seen in FIG. 1, when shot gun 16 is mounted within guard 10, trigger guard 16*a* rests on bottom flap 62 to support the weapon and prevent its removal from the bottom. Top flap 64 prevents removal from the top.

Lock 42 is a combination lock with a series of push buttons 72, lock bolt 38 already described, and rotatable knob 74 to actuate lock bolt 38. Mounted by welding on the back of tab 34 is a so-called hat 75 with an opening 75*a* for lock bolt 38 to pass through to provide further protection against prying. Typically, knob 74 would be turned counter clockwise with cover 22 closed to lock guard 10 by extending bolt 38 outwardly to pass through tab 28. To retract bolt 38 it would be necessary to push the correct combination of push buttons 72 first before knob 74 could be turned clockwise to unlock guard 10 and open cover 22 to permit removal of gun 16. Spring 30 as previously noted is mounted to bias cover 22 to open, so that when knob 74 is turned clockwise to retract lock bolt 38, cover 22 will spring open. In an emergency condition, as when a prowler is discovered, the rapidity by which the weapon can be recovered can mean the difference between safety and disaster.

Figure 3A:
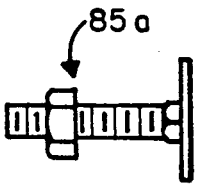
FIG. 3*a* is a side view of the elevator bolt.
Figure 3:
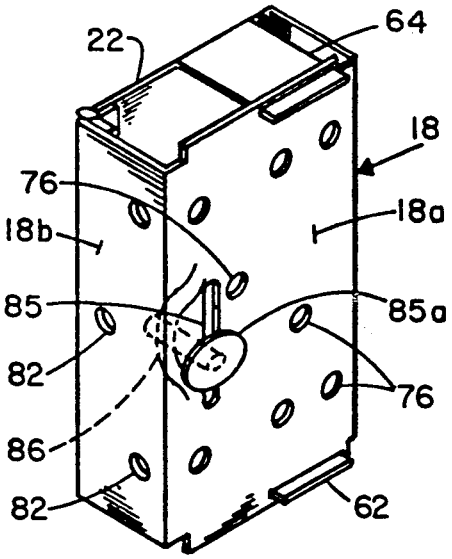
FIG. 3 is an isometric view of the preferred embodiment showing the two sides which are attached to the walls forming the corner.

As more particularly seen in FIG. 3, housing 18 is provided with a plurality of holes 76 in back face 18*a* to accomodate screws 78 for mounting on wall 14 and holes 82 to accomodate screws 84 for mounting on wall 12, for a corner mounting. It is understood that guard may be mounted on a single wall if desired or required. Also, guard 10 can be inverted if it is to be mounted on an oppositely facing corner. In addition, housing 18 may be provided with a slot 85 to accomodate an elevator bolt 85*a*, also shown in FIG. 3, for use when guard 10 is used with a pistol. In this situation, bolt 85*a* passes through trigger guard 86 (shown in phantom) which is a part of the pistol to prevent its removal.

The use of spring 30 enhances the utility of this invention by making it possible to remove the weapon more rapidly in a crisis situation. Since cover 22 will pop open once knob 74 is turned this means that the gun owner can obtain the weapon a few seconds faster which could save his life under some circumstances.

In the arrangement just described it is seen that there has been provided a protective device useful with rifles, shotguns, and similar firearms which is highly effective, easy and economic to manufacture and install, and very difficult to defeat.

While only certain preferred embodiments of this invention have been described it is understood that many variations of this invention are possible without departing from the principles of this invention as defined in the claims which follow.

What is claimed is:

1. Apparatus for mounting and locking on a wall a firearm having a trigger and a trigger guard comprising:

a. extended housing means U-shaped in section formed by a rear face and a pair of parallel side faces extending from said rear face and terminating in a pair of exposed edges running the length of said housing means and including means for attachment to a wall;

b. hinge means mounted along the edge of the first one of said side faces;

c. the other side face being folded toward the aforesaid first one of said side faces forming an extended shoulder parallel to and spaced from said rear face and folded again to form a first tab means parallel to and spaced from said side faces, a slot being formed in said shoulder and an opening being formed in said first tab means;

d. extended cover means having a pair of parallel extended edges attached along one edge to said hinge means so that said cover means can open and close the front of said housing means, the other extended edge of said cover means being folded to form a second tab means to engage said slot and third tab means to be flush with said first tab means when said cover means is closed;

e. lock means mounted on said cover means having a bolt aligned with the opening in said first tab means so that said bolt will enter said opening when said lock means is moved into its locking position when said cover means is closed, said firearm extending through said housing with said trigger guard contained within said housing with said cover means closed and locked; and f. means for preventing said firearm from being moved out of said housing when said cover means is closed.

2. The apparatus of claim 1 wherein said preventing means comprises slots at each end of said rear face and flaps extending down from said cover means for entering said slots when said cover means is closed preventing said trigger guard from sliding out of said housing means.

3. The apparatus of claim 2 wherein said wall attachment means comprises openings in said rear face to accomodate fasteners to attach said rear face to a wall.

4. The apparatus of claim 2 wherein said wall attachment means comprises openings in one of said side faces to accomodate fasteners for attachment to a wall.

5. The apparatus of claim 2 wherein said wall attachment means comprises openings in said rear face and an side face to accomodate fasteners to attach said housing to a corner formed by two walls.

6. The apparatus of claim 5 wherein said second tab means comprises a plurality of spaced tabs and said first tab means is provided with a plurality of spaced slots to accomodate said second tab means when said cover means is closed.

7. The apparatus of claim 6 wherein said housing means is made from a single sheet of heavy gauge steel from which said tabs and faces are formed.

8. The apparatus of claim 7 wherein said lock means comprises a combination lock.

9. The apparatus of claim 8 wherein said third tab means comprises a plurality of tabs between said second tab means tabs being flush with said first tab means when said cover means is closed.

10. The apparatus of claim 9 wherein said cover means is made from a single sheet of heavy gauge steel from which said flaps are formed, and said lock is mounted on the underside of said cover means.

11. The apparatus of claim 1 having means for popping open automatically said cover means when said lock means is unlocked.

12. The apparatus of claim 1 having means to engage the trigger guard of a handgun so that said guard can be employed with a rifle, shotgun or a handgun.

* * * * *